US006964582B2

(12) United States Patent
Zhuang et al.

(10) Patent No.: US 6,964,582 B2
(45) Date of Patent: Nov. 15, 2005

(54) ELECTRICAL CONNECTOR

(75) Inventors: Quan Zhuang, Kunsan (CN); Wei-Xing Chen, Kunsan (CN); Guang-Ming Zhao, Kunsan (CN); Zhi-Qiang Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/998,854

(22) Filed: Nov. 29, 2004

(65) Prior Publication Data

US 2005/0124217 A1 Jun. 9, 2005

(30) Foreign Application Priority Data

Dec. 6, 2003 (CN) ..... 20120351 A

(51) Int. Cl.[7] ..... H01R 4/66
(52) U.S. Cl. ..... 439/607
(58) Field of Search ..... 439/607–610

(56) References Cited

U.S. PATENT DOCUMENTS

| | | | | |
|---|---|---|---|---|
| 5,158,471 | A | 10/1992 | Fedder et al. | |
| 5,295,843 | A | 3/1994 | Davis et al. | |
| 5,927,999 | A | 7/1999 | Shimojyo | |
| 6,290,535 | B1 * | 9/2001 | Lin et al. | 439/541.5 |
| 6,322,397 | B1 | 11/2001 | Zhang | |
| 6,884,094 | B1 * | 4/2005 | Bernhart et al. | 439/101 |
| 2004/0043659 | A1 * | 3/2004 | Lai | 439/607 |

* cited by examiner

*Primary Examiner*—Tho D. Ta
*Assistant Examiner*—James R. Harvey
(74) *Attorney, Agent, or Firm*—Wei Te Chung

(57) ABSTRACT

A power connector (1) includes an insulative housing (10), a number of conductive contacts (20) received in the insulative housing, a first shell (30) enclosing the insulative housing and a second shell (40) enclosing the first shell. The insulative housing includes a base portion (101) and a tongue portion (103) extending forwardly from the base portion. The cross-section of each of the first and the second shells consists of a pair of straight sections (308, 408) parallel to each other and a pair of arcuate sections (308', 408') each connecting with the pair of straight sections.

4 Claims, 8 Drawing Sheets

ELECTRICAL CONNECTOR

BACKGROUND OF THE INVENTION

1. Field of the Invention

The present invention relates to an electrical connector, and particularly to a power connector which mates with a complementary connector conveniently and accurately.

2. Description of Related Art

With the development of electronic industry, more and more consumer electronic products enter into our daily life. Miniaturization, integration and multi-function are common developing trend of current consumer electronic products. The density of the electronic components integrated on an integrate circuit becomes more and more big. Therefore, the power current needed by the electronic equipment is increased and a power connector of the electronic product usually disposes a relatively large number of contacts therein for higher power transmission.

U.S. Pat. No. 5,158,471 discloses a power connector with large number of contacts disposed therein. The contacts are disposed in an insulative housing of the power connector with fine pitch and without sufficient positioning means. When the power connector mates with a complementary connector, an accurate engagement therebetween is relatively difficult to realize and the contacts of the power connector have a possibility of being bent by the complementary connector. Thus, the power transmission between the power connector and the complementary connector is influenced.

Hence, an improved electrical connector is desired to overcome the disadvantages of the prior art.

SUMMARY OF THE INVENTION

An object of the present invention is to provide an electrical connector which mates with a complementary connector accurately and conveniently.

To achieve the above object, an electrical connector in accordance with the present invention comprises an insulative housing including a base portion and a tongue portion extending forwardly form the base portion, a plurality of conductive contacts received in the insulative housing, a first shell enclosing the insulative housing and a second shell enclosing the first shell. The cross-section of each of the first and the second shells consists of a pair of straight sections parallel to each other and a pair of arcuate sections each connecting with the pair of straight sections.

Other objects, advantages and novel features of the invention will become more apparent from the following detailed description when taken in conjunction with the accompanying drawings.

DETAILED DESCRIPTION OF THE INVENTION

Figure 1:
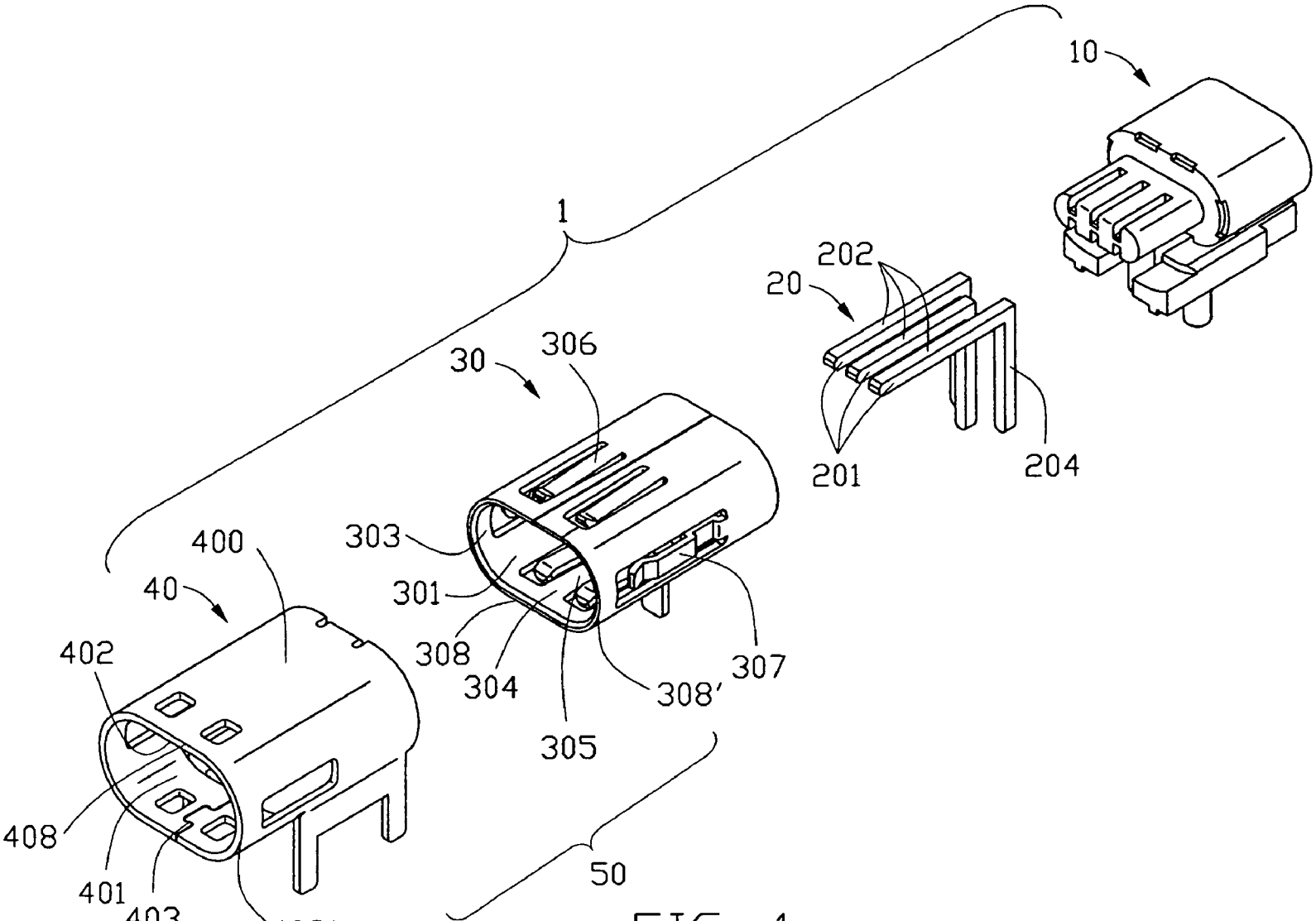
FIG. 1 is a perspective, exploded view of an electrical connector in accordance with the present invention.
Figure 2:
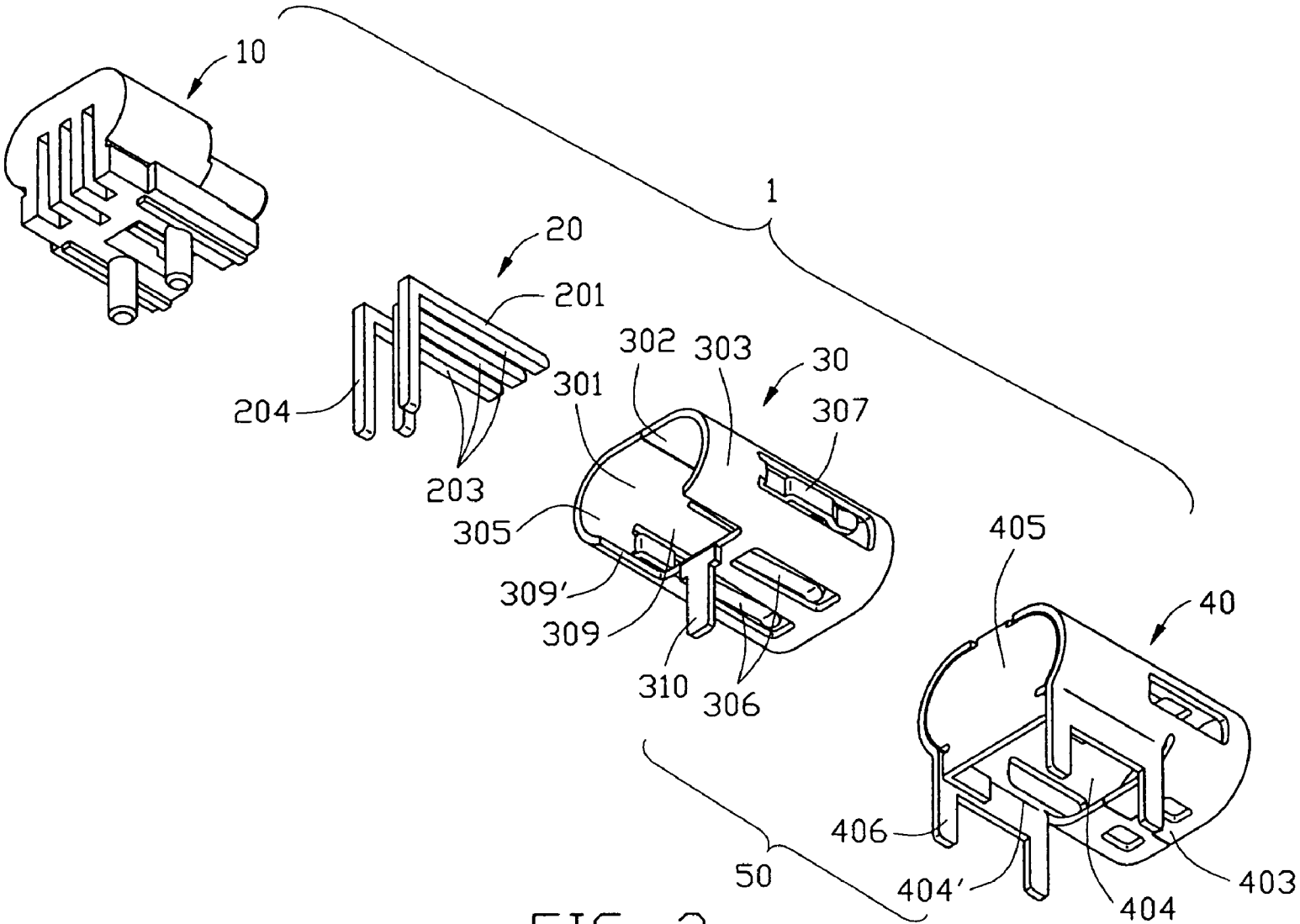
FIG. 2 is a view similar to FIG. 1, but taken from a different aspect.

Referring to FIGS. 1 and 2, an electrical connector 1 in accordance with the present invention comprises an insulative housing 10, a plurality of conductive contacts 20 received in the insulative housing 10, and a conductive shield 50 comprising a first shell 30 and a second shell 40.

Figure 3:
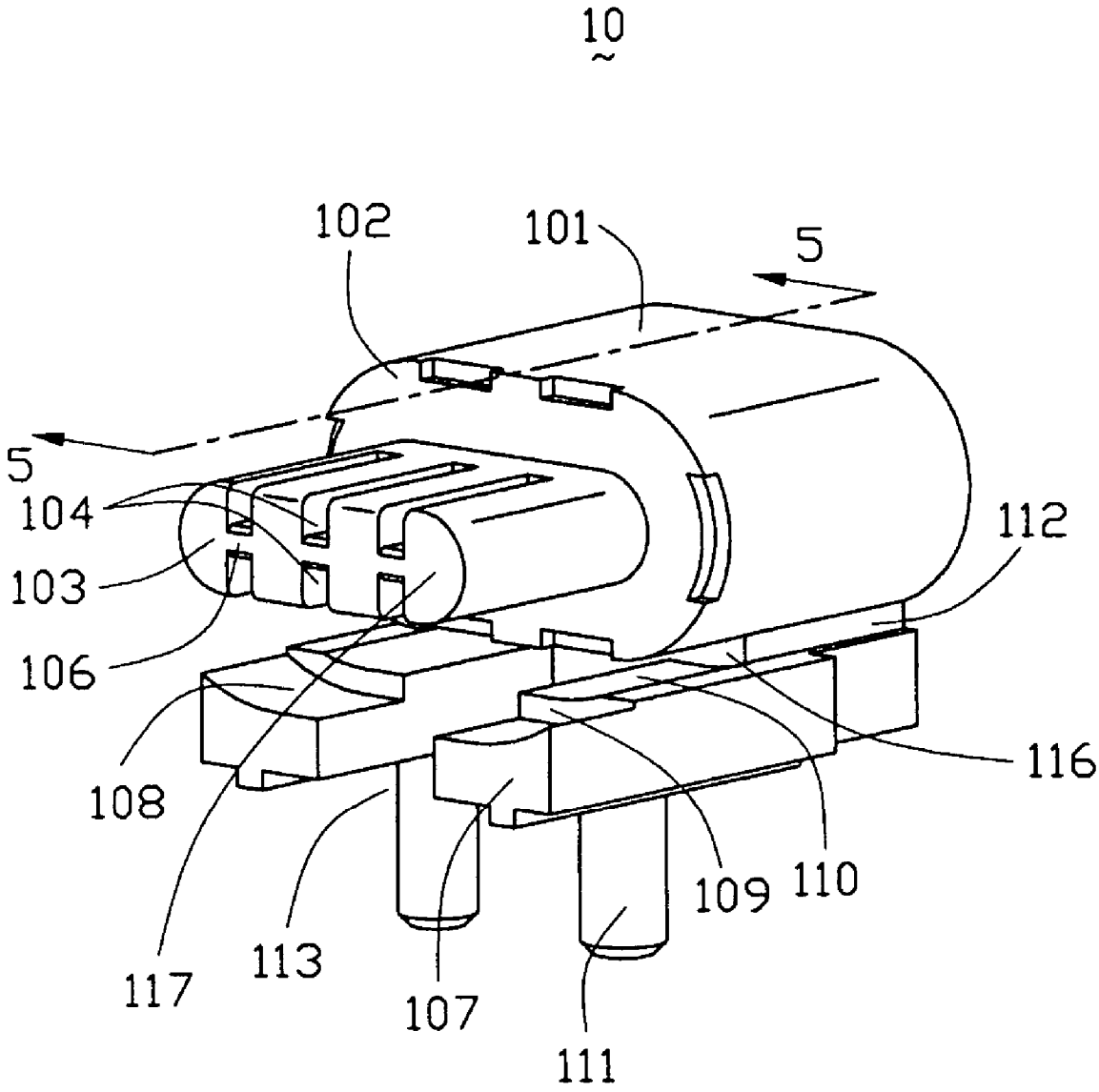
FIG. 3 is a perspective view of an insulative housing of the electrical connector of FIG. 1.
Figure 4:
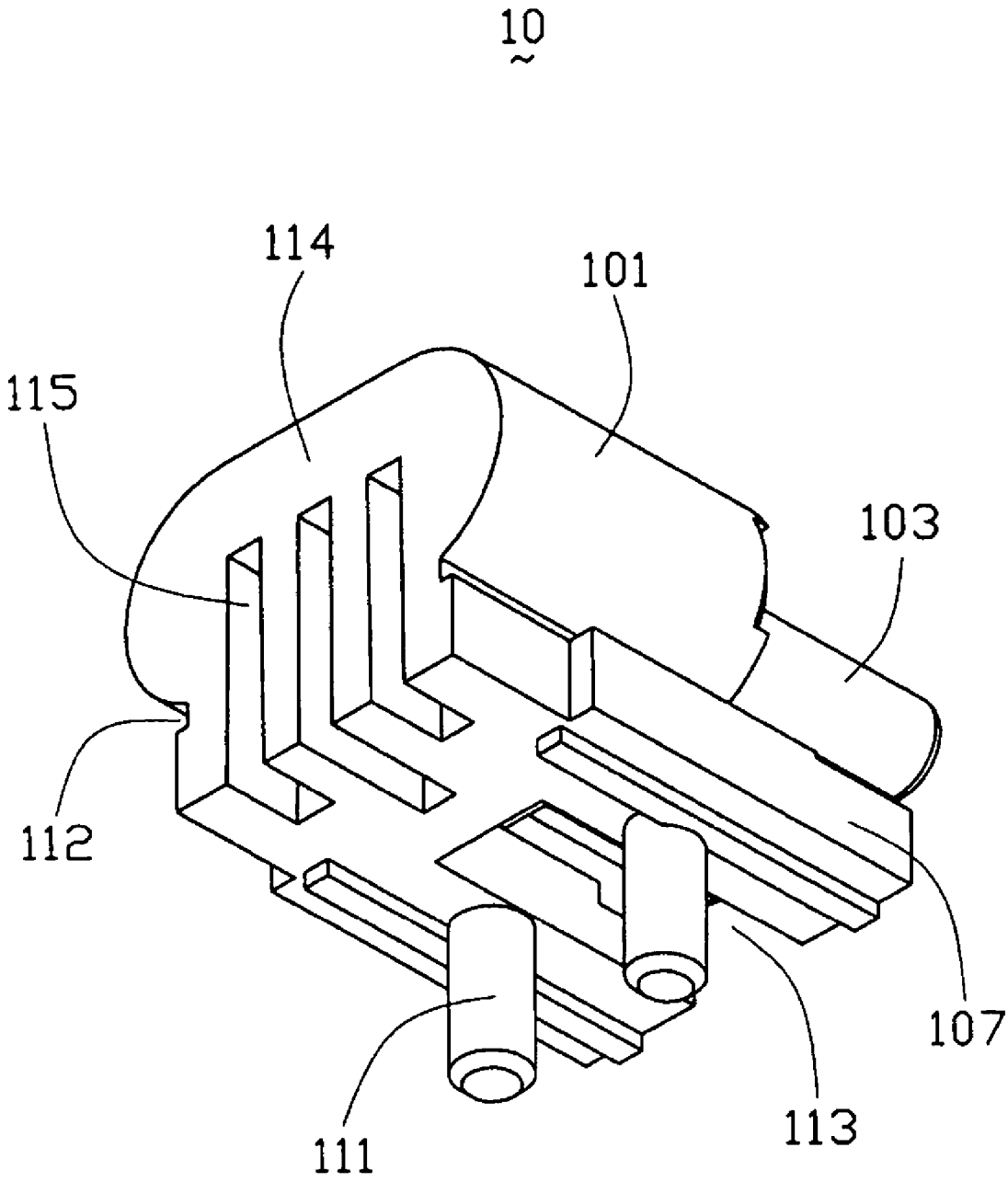
FIG. 4 is a view similar to FIG. 3, but taken from a different aspect.
Figure 5:
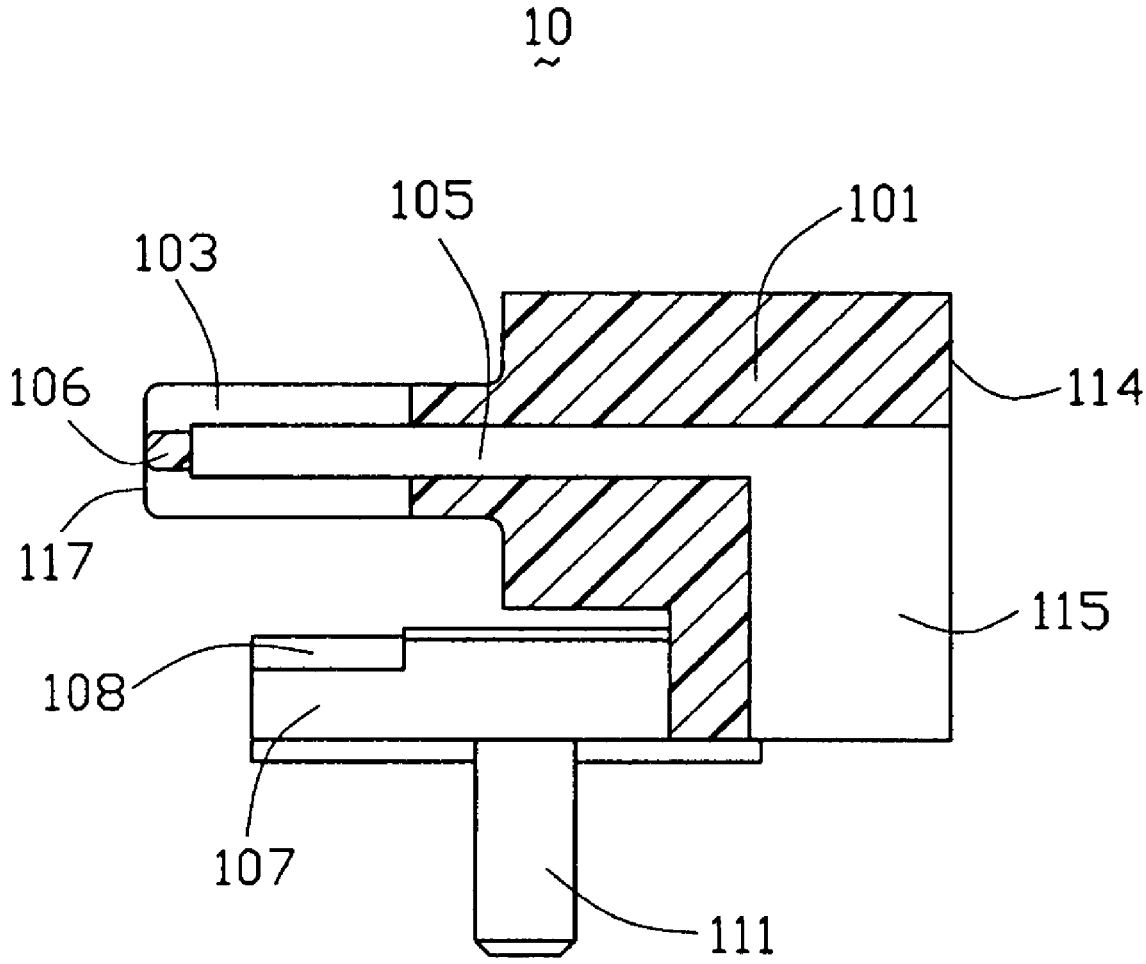
FIG. 5 is a cross-sectional view taken along line 5—5 of FIG. 4.

Referring to FIGS. 3–5, the insulative housing 10 comprises a base portion 101 including a front face 102 and an opposite rear face 114, a tongue portion 103 extending forwardly from the front face 102 of the base portion 101, a pair of mounting portions 107 formed below the base portion 101 and located at opposite sides of the base portion 101, and a neck portion 106 interconnecting the base portion 101 with the mounting portions 107. The base portion 101 and the tongue portion 103 each is a substantially elliptoid column. A plurality of contact receiving passages 105 recess forwardly from the rear face 114 of the base portion 101 toward a front surface 117 of the tongue portion 103. The rear face 114 of the base portion 101 is slotted with a plurality of vertical grooves 115 extending forwardly to communicate with the contact receiving passages 105, respectively. The middle vertical groove 115 recesses more forwardly than the other two vertical grooves 115. Opposite upper and lower surfaces of the tongue portion 103 is cut off to form plural pairs of elongated recesses 104 respectively communicating with a corresponding contact receiving passage 105. A block 106 is, thus, formed between the front surface 117 of the tongue portion 103 and the contact receiving passage 105. A guiding channel 112 is formed by a bottom surface of the base portion 101, a top surface of a corresponding mounting portion 107 and the neck portion 116. The top surface of each mounting portion 107 is step-shaped and comprises a lower guiding surface 108 and an upper guiding surface 110 lower than the lower guiding surface 108. A step 109 is, thus, formed between the upper and the lower guiding surfaces 110, 108. The upper and the lower guiding surfaces 110, 108 are of arc-shape. A column post 111 depends downwardly from a bottom surface of each mounting portion 107. A rectangular gap 113 is formed between the pair of mounting portions 107.

Referring to FIGS. 1–2, each conductive contact 20 is substantially L-shaped and comprises a flat contacting portion 201 and a vertical tail portion 204. The contacting portion 201 comprises an upper contacting surface 202 and an opposite lower contacting surface 203. The length of the contacting portion 201 of the middle conductive contact 20 is shorter than that of the contacting portions 201 of the other two conductive contacts 20.

Continuing to FIGS. 1–2, the first shell 30 is stamped from a metallic sheet and is a hollow elliptoid column. The peripheral of the first shell 30 surrounds a first receiving space 301. A rectangular first cutout 309 is defined in a bottom wall 304 of the first shell 30. A first flat positioning portion 310 depends downwardly from a front edge of the cutout 309. A top wall 302 and the bottom wall 304 of the first shell 30 each is formed with a pair of first spring arms 306 bending toward the receiving space 301 and extending forwardly. Each sidewall (not labeled) is formed with a second spring arm 307 extending forwardly and bending toward the receiving space 301. The cross-section of the first shell 30 consists of a pair of straight sections 308 parallel to each other and a pair of arcuate sections 308' each connecting with the pair of straight sections 308.

The second shell 40 has the substantially same configuration as that of the first shell 30 and comprises a main body 400 and a rear part 405 vertically extending from a top wall 402 of the main body 400. The second shell 40 also defines a second receiving space 401, and a rectangular second cutout 404 is defined in a bottom wall 403 of the second receiving space 401. A pair of second flat positioning portions 406 depend downwardly from each of opposite side edges 404' of the second cutout 404. The cross-section of the second shell 40 also consists of a pair of straight sections 408 parallel to each other and a pair of arcuate sections 408' each connecting with the pair of straight sections 408.

Figure 6:
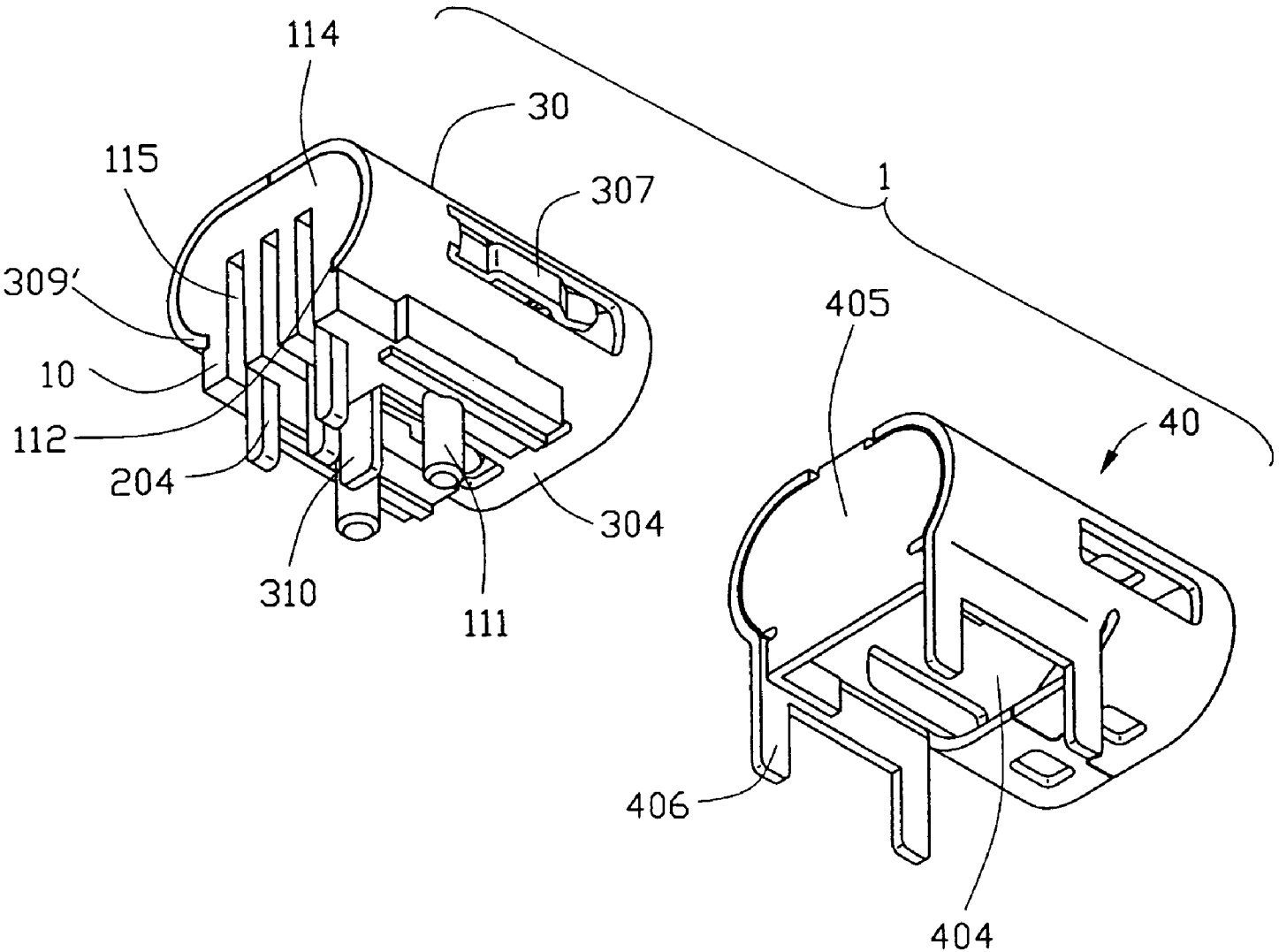
FIG. 6 is a partially assembled view of FIG. 2.

Referring to FIGS. 1–2 and 6, in assembly, the contacting portions 201 of the conductive contacts 20 protrude through corresponding contact receiving passages 105 until a forward end of each contacting portion 201 abuts against a corresponding block 106. The tail portions 204 are respectively received in the vertical grooves of the insulative housing 10 and extend beyond bottom surfaces of the mounting portions 107 for being soldered to a printed circuit board (not shown). The upper and lower contacting surfaces 202, 203 of each conductive contact 20 are respectively arranged on the opposite upper and lower surfaces of the tongue portion 103 and exposed in the corresponding pair of recesses 104.

The first shell 30 is then assembled to the insulative housing 10. Continuing to FIGS. 1–2 in conjunction with FIG. 6, the opposite side edges 309' of the first cutout 309 of the first shell 30 respectively slide along the guiding channels 102 of the insulative housing 10 to guide an insertion of the first shell 30 to the insulative housing 10. The pair of second spring arms 307 of the first shell 30 elastically presses on opposite sidewalls of the base portion 101 with the bottom wall 304 of the first shell 30 abutting against the upper guiding surfaces 110 of the pair of mounting portions 107. The first positioning portion 310 abuts against a rear edge of the gap 113.

Figure 7:
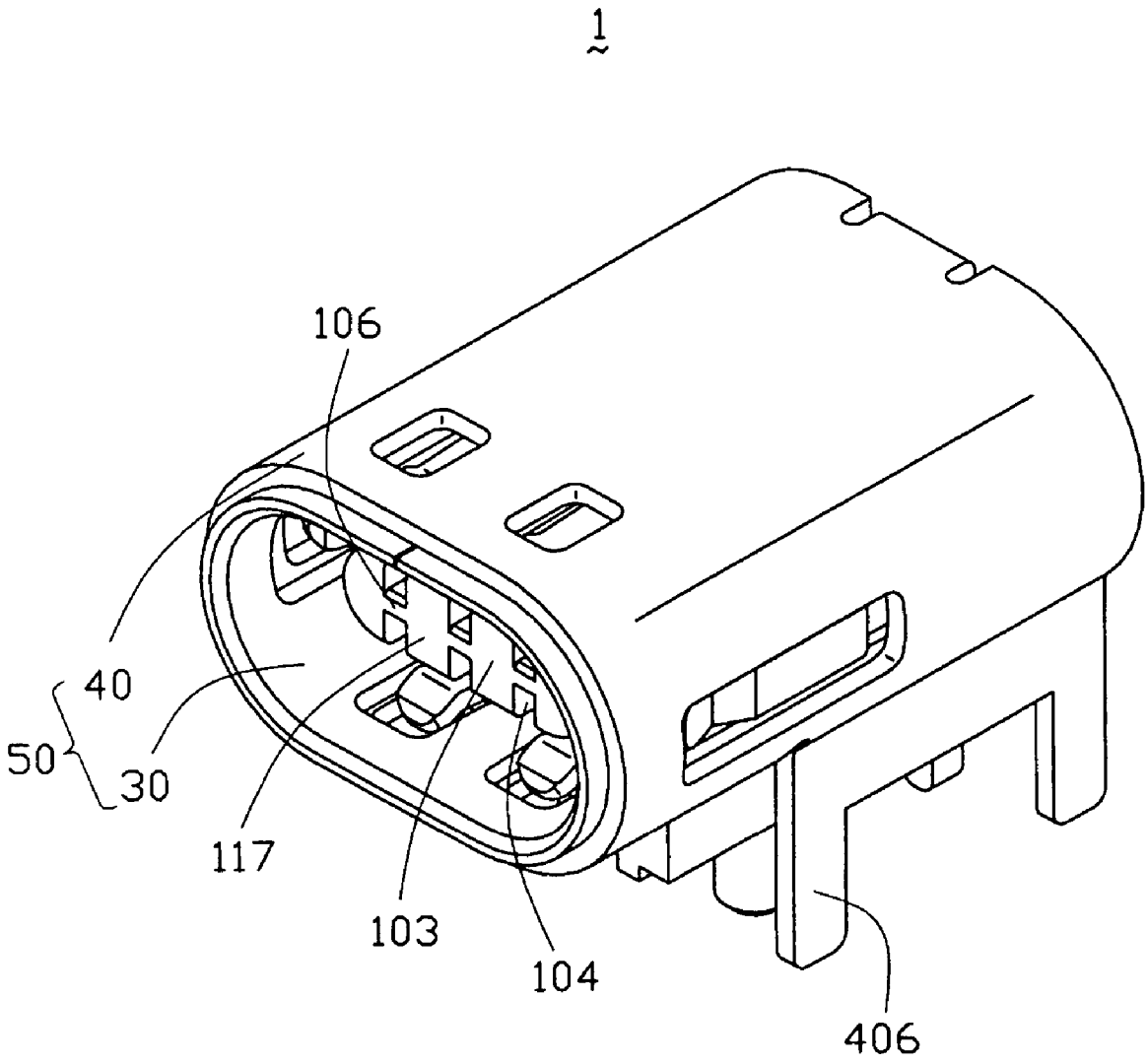
FIG. 7 is an assembled view of FIG. 1.
Figure 8:
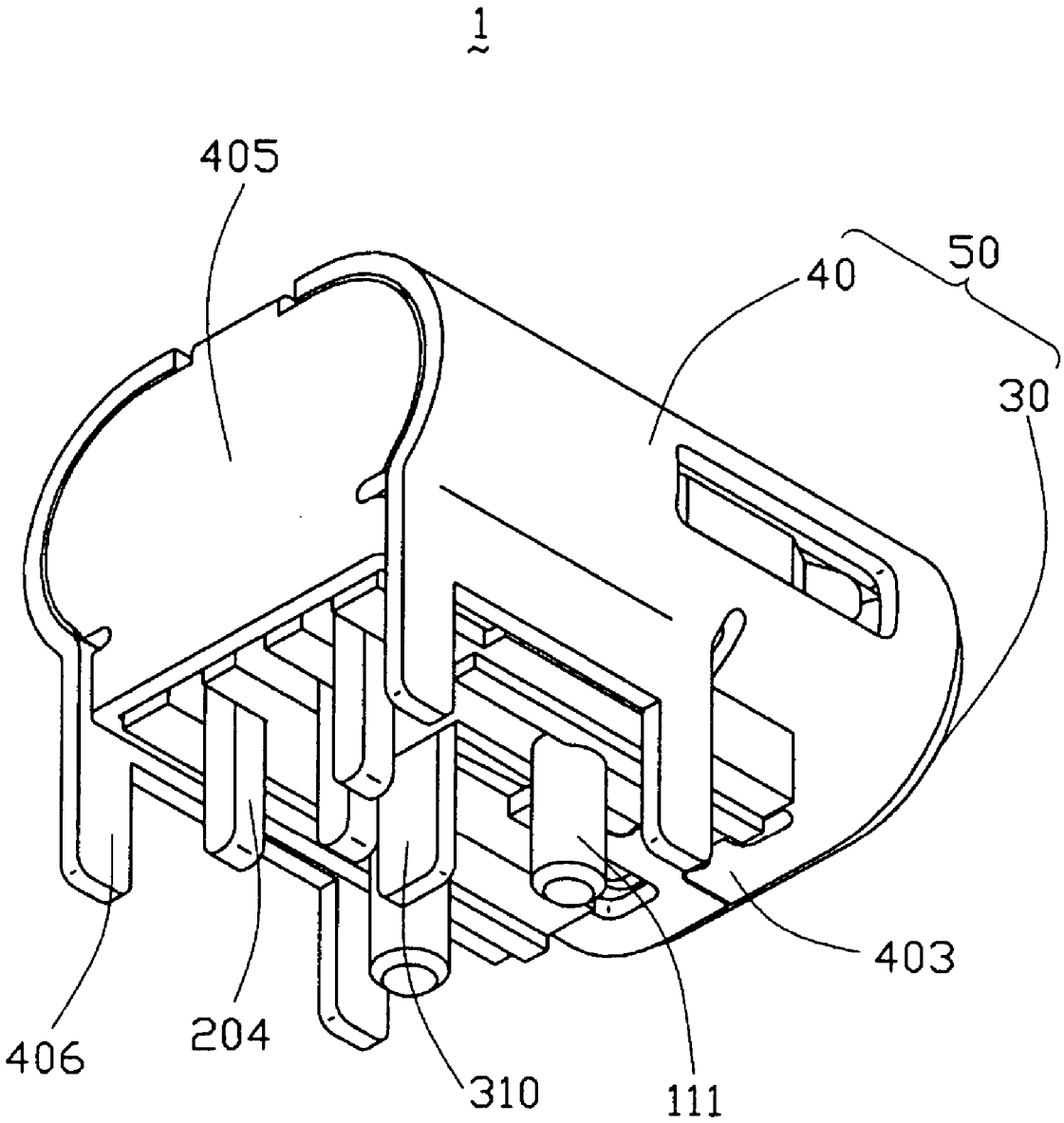
FIG. 8 is a view similar to FIG. 7, but taken from a different aspect.

FIGS. 7–8 illustrates how the second shell 40 is assembled to the first shell 30. The bottom wall 403 of the second shell 40 attaches to the lower guiding surfaces 108 of the pair of mounting portions 107 of the insulative housing 10 closely. A front edge of the second cutout 404 defined in the bottom wall 403 abuts against the step 109 formed between the upper and the lower guiding surfaces 110, 108. The rear part 405 of the second shell 40 is bent to enclose rear surfaces of the insulative housing 10 and the second shell 30. Therefore, the first shell 30 and the insulative housing 10 with the conductive contacts 20 assembled therein are partially received in the second receiving space 401 of the second shell 40. The column posts 111 of the insulative housing 10 are assembled to the printed circuit board and the first and the second positioning portions 310, 406 are respectively soldered to the printed circuit board.

Since the cross-section of the conductive shield 50 has a pair of arcuate sections to guide an insertion of a complementary connector (not shown), the engagement between the electrical connector 1 in accordance with the present invention and the complementary connector is more accurate and easy to realize.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

an insulative housing comprising a base portion, a tongue portion extending forwardly from the base portion and a plurality of contact receiving passages defined in the base portion and the tongue portion;

a plurality of conductive contacts respectively received in said contact receiving passages of the insulative housing; and a conductive shield enclosing the insulative housing, the cross-section of the conductive shield consisting of a pair of straight sections parallel to each other and a pair of arcuate sections each connecting with the pair of straight sections;

wherein the conductive shield comprises a first shell enclosing the insulative housing and a second shell enclosing the first shell, and wherein the first and second shells have the same cross-section configuration as each other;

wherein the insulative housing forms a lower guiding surface engaging with the second shell and an upper guiding surface engaging with the first shell;

wherein the insulative housing forms a pair of mounting portions at opposite sides of the base portion, and wherein each mounting portion is formed with the upper and the lower guiding surfaces.

2. The electrical connector as claimed in claim 1, wherein the first shell forms a plurality of spring arms elastically pressing on the insulative housing.

3. The electrical connector as claimed in claim 1, wherein the base portion of the insulative housing and each mounting portion together define a guiding channel for guiding an insertion of the conductive shield.

4. The electrical connector as claimed in claim 1, wherein the tongue portion of the insulative housing defines plural pairs of recesses respectively communicating with the contact receiving passages, and wherein each conductive contact comprises an upper and a lower contacting surfaces respectively exposed in a corresponding pair of recesses.

* * * * *